US005755359A

United States Patent [19]

Jöensson

[11] Patent Number: 5,755,359

[45] Date of Patent: May 26, 1998

[54] OPENING DEVICE FOR A LIQUID PACKAGE

[75] Inventor: Leif T. Jöensson, Rydebäck, Sweden

[73] Assignee: Tetra Laval Holdings & Finance, S.A., Pully, Switzerland

[21] Appl. No.: 663,075

[22] PCT Filed: Feb. 10, 1995

[86] PCT No.: PCT/EP95/00475

§ 371 Date: Jun. 19, 1996

§ 102(e) Date: Jun. 19, 1996

[87] PCT Pub. No.: WO95/25671

PCT Pub. Date: Sep. 28, 1995

[30] Foreign Application Priority Data

Mar. 24, 1994 [DE] Germany ..... 44 10 205.4

[51] Int. Cl.[6] ..... B65D 51/22

[52] U.S. Cl. ..... 222/83; 220/277; 222/541.2; 222/566; 229/204

[58] Field of Search ..... 222/81, 83, 541.2, 222/566; 229/204; 220/267, 268, 277, 278; 215/302, 303; 30/2

[56] References Cited

U.S. PATENT DOCUMENTS

| | | | |
|---|---|---|---|
| 848,456 | 3/1907 | Garrecht | 220/277 |
| 999,957 | 8/1911 | Carman | 220/277 |
| 1,843,806 | 2/1932 | Compton | 220/277 |
| 1,872,585 | 8/1932 | Hegenberger | 220/277 |
| 2,337,687 | 12/1943 | Sebell | 220/277 |
| 3,463,347 | 8/1969 | Kerr | 220/277 |
| 4,483,464 | 11/1984 | Nomura | 222/83 |
| 4,634,013 | 1/1987 | Bar-kokhba | 222/83 X |
| 4,717,039 | 1/1988 | Ayyoubi . | |
| 4,723,689 | 2/1988 | Vallos et al. | 222/83 X |
| 4,901,435 | 2/1990 | Tahara | 222/83 X |
| 4,907,722 | 3/1990 | Ueda et al. | 222/83 |
| 4,915,290 | 4/1990 | Robichaud et al. | 220/269 X |
| 4,930,683 | 6/1990 | Färber . | |
| 5,009,364 | 4/1991 | Bolte . | |
| 5,020,690 | 6/1991 | Kishikawa et al. . | |
| 5,069,372 | 12/1991 | Kawajiri . | |
| 5,101,999 | 4/1992 | Robichaud et al. | 220/267 X |

FOREIGN PATENT DOCUMENTS

| | | | |
|---|---|---|---|
| 0191230 | 8/1986 | European Pat. Off. . | |
| 0531813 | 3/1993 | European Pat. Off. . | |
| 3832412 | 4/1989 | Germany . | |
| 3808303 | 9/1989 | Germany . | |
| 3901517 | 8/1990 | Germany . | |
| 377477 | 12/1939 | Italy | 220/277 |
| 639107 | 5/1962 | Italy | 220/278 |
| 262236 | 6/1949 | Switzerland | 220/277 |

*Primary Examiner*—Kevin P. Shaver

*Attorney, Agent, or Firm*—Killworth, Gottman, Hagan & Schaeff, L.L.P.

[57] ABSTRACT

Apparatus for forming a reclosable opening in a top wall of a fluid pack while maintaining sealing integrity of the pack until it is first opened includes an opening member secured to the top wall of the pack. The opening member includes an inner disk portion having a central opening and an outer annular portion with the disk portion and the annular portion being separated by a slot which is interrupted by a bridging portion so that it extends circularly over almost 360°. A tongue is mounted for rotation about the central opening and includes a blade extending from the underside of the tongue. The blade is spaced along the tongue to be received within the slot. The blade is longer than the opening member is deep so that the blade pierces the pack and opens the pack as the tongue is rotated to move the blade along the slot. The inner disk portion can then be hinged between a closed position in alignment with the outer annular portion and an opened position generally perpendicular to the outer annular portion.

11 Claims, 4 Drawing Sheets

OPENING DEVICE FOR A LIQUID PACKAGE

BACKGROUND OF THE INVENTION

The invention concerns an arrangement for opening a pack, on the top wall of which are provided means for opening and re-closing same.

There are packs which are made from plastic-coated paper by folding and sealing and in the upper end portion of which a hole is left in the paper at a corner in such a way that the hole is closed by an injection-molded rib of plastic material, and joined to a tongue. From the location of the pouring edge, the rib extends a distance towards the center of the upper end portion of the pack and is there joined by way of a pin of a mushroom-like configuration in cross-section, through a hole in the top wall. To open the pack, the user grips the injection-molded tongue and tears up the rib which is disposed predominantly in the interior of the pack, along a perforation in the paper of the upper end portion of the pack, in order to form a tear-open tongue and thus a pouring opening. To provide the opening arrangement, that known pack requires a comparatively expensive injection-molding procedure in the region of the upper end portion of the pack. In the case of an aseptic pack, the holes and openings in the top wall of paper, which are closed by the plastic material injection-molded therein, cannot be provided with the necessary gas barriers, for example a metal foil.

In the case of another fluid pack which consists entirely of filled plastic material, a hole in the upper end portion of the pack is closed by a two-part opening arrangement which is of a flat configuration in such a way that no parts thereof project beyond the overall contour of the top wall. This involves a prefabricated opening arrangement which is kept in a magazine and which comprises a lower portion and an upper portion which are connected together by way of a hinge-like fold line. For sealing purposes, a thin plastic foil is disposed between the lower and upper portions and fixed on the lower portion, thereby guaranteeing sealing integrity. That known opening arrangement presupposes a hole with an upstanding collar in the top wall of the pack in order to afford possible ways of providing an anchorage effect. In the case of an aseptic pack the hole region would have to be especially covered over.

An opening arrangement of plastic material which is sealed on to a liquid pack of paper, provided with suitable perforation lines, is also known. That opening arrangement comprises a first outer portion with an edge to assist with pouring, and a second inner portion which is arranged internally separately therefrom at a spacing relative thereto and is movable relative to the outer portion, both said portions being injection-molded from plastic material and being kept in stock. The design configuration of the parts of the opening arrangement is rather complicated and expensive and the two portions are connected together by threads which are cast in place and one of which projects as a loop for opening the pack.

For opening the pack for the first time, the user applies pressure to the inner portion, whereby it rotates about a pivot point and the paper therebeneath tears through along perforation lines, with the inner portion turning about a horizontal axis.

The object of the invention is to provide a pack having an arrangement with the features of the kind set forth in the opening part of this specification, in such a way that, while being simple to manufacture and involving user-friendly handling when opening the pack, absolute sealing integrity of the pack until it is first opened is guaranteed and possibly aseptic conditions in respect of the interior of the pack can be better maintained until it is opened for the first time.

SUMMARY OF THE INVENTION

In accordance with the invention that object is attained in that a disk of plastic material is sealed on the top wall, in the center it has an opening for accommodating a rotary pin and at a spacing around said opening it has a slot which extends in a circular configuration over almost 360° and which is interrupted by at least one bridging portion on the side in opposite relationship to the pouring edge, that a tongue is arranged on the disk rotatably about the axis of the rotary pin, and that a blade which projects into the slot is fixed to the tongue on the underside and is longer than the thickness of the disk.

The production of such an opening arrangement is simpler for only two portions which are preferably releasably connected together have to be previously produced by injection molding from plastic material, namely the disk and the tongue. In addition the opening arrangement can be sealed on to a closed top wall of a pack without the pack having to have an opening even only at one single location. This guarantees absolute sealing integrity until the pack is first opened. Furthermore the inner surfaces of the pack can be provided with a gas barrier, for example covered with a metal foil, so that when dealing with sterile materials to form the filling of the pack, the aseptic filling conditions of the pack can also be guaranteed until the pack is opened for the first time. Handling of the pack when opening same is advantageously a logical and simple matter.

The disk of plastic material is divided into two portions by the circularly extending slot, except for the interruption, which portions are connected together in the region of the interruption in order for example to form a hinge. Both portions of the disk, namely the inner circular disk portion and the outer annular portion are sealed on the surface of the pack, which has plastic material. Except for the bridging portion by which the partial-circular configuration of the slot is interrupted, the two portions of the disk are at a radial spacing from each other.

The plastic material of the tongue enjoys adequate softness or elasticity so that the tongue is bendable relative to the axis of the rotary pin. The above-mentioned blade is mounted on the underside of the tongue at the spacing of the radius of the circular slot from the axis of the rotary pin, and extends downwardly over the described length. The blade is held in a rest position in the region of the bridging portion so that it does not damage the top wall. For example the tip of the blade can lie on the plastic material of the disk which is not perforated through same at that location.

If the user wants to open the top wall of the pack, he then flexes the tongue upwardly away from the top wall and rotates it about the axis of the rotary pin until the blade is at any location above the slot. Here, the user releases the tongue so that the blade moves into the slot. Possibly, if in that situation the blade should not yet have pierced the top wall, the user presses on to the tongue from above and thus pushes the tip of the blade through the top wall under the slot. In that operation of piercing the top wall for the first time, the procedure may also involve contact of a cutting edge of the blade with the top wall. Laterally thereof the blade also has at least one edge so that the user can now turn the tongue about the axis of the rotary pin in one direction or the other so that the top wall is cut over an arc of almost 360° in the region below the circular slot, except for the above-mentioned bridging portion.

Preferably the opening arrangement, that is to say the disk according to the invention, is disposed in the vicinity of an outer edge of the top wall of the pack so that the pouring edge will be disposed there. If the user places the tongue over the pouring edge, with a partial return rotary movement thereof, then the blade is in the slot on the side opposite to the bridging portion. If the user then bends the tongue up, in which respect directions for use preferably mark the hinge location, the tongue can hinge-like fold out the part of the top wall which is under the inner circular disk portion, in such a way that an opening is made completely free, forwardly towards the pouring edge. It will be seen that handling the arrangement when opening the pack is a simple and user-friendly operation.

The arrangement according to the invention however can also be re-closed. The user then only needs to push the tongue down again so that the inner circular disk portion moves into the original position and re-closes the top wall, except for the narrow circular slot.

The disk is sealed on the top wall which has plastic material, at least in a point-wise or line-wise manner but preferably over the entire surface area, both in the region of the outer annular portion and also the inner circular disk portion. The outer contour of the disk ray be oval, round or polygonal, for example square or triangular. Preferably it is round. In that respect the radius of the outer annular portion is preferably larger by one-third to one-quarter of the radius of the inner circular disk portion than the radius of the inner circular disk portion.

The blade can comprise plastic material or metal and can be fixed to the underside of the tongue. The reference to 'downwardly' means here a direction perpendicularly on to the top wall, in which respect a fluid pack is generally so positioned that the pouring device with the opening arrangement described herein is mounted on the wall 'at the top', namely the top wall. It is preferably flat but only needs to be so flat in the region of the opening arrangement that the tongue can be rotated for cutting it open along the circular slot.

So as to guarantee cutting of the top wall under the disk which is sealed on to the pack, the blade, when the tongue is pressed down towards the top wall, must be certain to cut through the material of the top wall. That is achieved when the blade is longer than the thickness of the disk.

Such an opening arrangement can be used to open both packs which entirely or partially consist of plastic material and also packs which comprise plastic-coated paper.

In accordance with the invention it is desirable in that respect if there are provided two spaced-apart web-like bridging portions between which there is disposed an upwardly open blind recess in the disk. While admittedly a single web-like bridging portion which is disposed as a prolongation of the circular slot is sufficient, the reliability of the arrangement however is considerably improved if two spaced-apart bridging portions are provided. If unexpectedly a bridging portion web should once tear because for example it has been moved too often, then the inner circular disk portion is still connected to the outer annular portion by way of the other web-like bridging portion.

The arrangement of an open blind recess between the two bridging webs is quite preferred. More specifically the blade can be lowered into the recess, in the rest position. Lifting it out for first opening the pack has already been described hereinbefore.

Prefabrication of the disk from plastic material and the tongue which is preferably mounted pivotably relative thereto is however a simple matter and can be effected using simple injection molding machines if, in a further configuration of the invention, the central opening for the rotary pin is enlarged towards the top wall of the pack and is preferably designed to extend entirely through the thickness of the disk. Admittedly that opening can be of a blind configuration in cross-section, but production of the injection molding mold both for the opening and also for the rotary pin which is suitably adapted thereto is even simpler if the opening extends through the entire thickness of the disk. The increase in size of the opening through the disk or the inner circular disk portion towards the top wall serves to rotatably connect the tongue to the disk in such a way that it cannot be readily pulled out. The tongue with rotary pin fitted thereto for example can be snap-fitted into the opening by bending the plastic pieces, in the production operation. It is possible also to envisage other conventional methods of arrangement.

An alternative embodiment of the invention is characterised in that, using the essential features in accordance with the foregoing description, an edge to assist with pouring is additionally disposed at the periphery of the disk, with the exception of the actual pouring edge. It will be appreciated that obviously no disruption, no resistance and no barrier should be provided on the pouring-out side.

The pouring-assistance edge preferably extends a small distance upwardly perpendicularly out of the disk, for example 1 to 5 mm, preferably 2 to 3 mm. In that way, after the top wall has been opened and torn out in the region of the inner circular disk portion, particularly when dealing with liquid contents in the pack, the liquid is prevented from running over the top wall. On the contrary it is guided forwardly by the pouring-assistance edge and can then run away over the pouring edge, without any disturbance.

It is further desirable in accordance with the invention if the spacing of the two ends of the pouring-assistance edge from each other is a little larger than the width of the tongue. In other words, in plan view the pouring-assistance edge can converge laterally in a funnel-like shape towards the pouring edge. Disposed then transversely at the front is the pouring edge which extends from the two spaced-apart ends of the pouring-assistance edge. If the pouring-assistance edge is the web, wall or edge which extends perpendicularly upwardly out of the disk, then the front ends thereof can be used to fix the tongue in the position of use, for example from first re-closure onwards.

In another desirable configuration of the invention, it can also be provided that the tongue is of a flat and elongate configuration in such a way that its length from the axis of the rotary pin which is preferably integrally connected thereto to its front end is from 1 to 3 cm and preferably 2 cm larger than the distance of the axis of the rotary pin from the pouring edge. If a tongue of such a configuration, after the top wall under the disk has been cut through for the first time, is placed in the position where the tongue is above the pouring edge, then admittedly it projects somewhat beyond the edge of the pack, but it makes it easier for the user to grip the tongue and fold it upwardly together with the inner circular disk portion, using the hinge in the region of the bridging portion.

The rotary pin can preferably be molded integrally with the tongue in the operation of injection molding the tongue. If another design configuration is preferred for mounting it in the above-described opening which increases in size towards the top wall of the pack, then it can obviously also be connected separately to the tongue by snap-engagement or clamping closure means, by latching engagement, or other known technology procedures.

BRIEF DESCRIPTION OF THE DRAWINGS

Further advantages, features and possible uses of the present invention will be apparent from the following description of preferred embodiments in conjunction with the accompanying drawings in which.

DETAILED DESCRIPTION OF THE INVENTION

Figure 1:
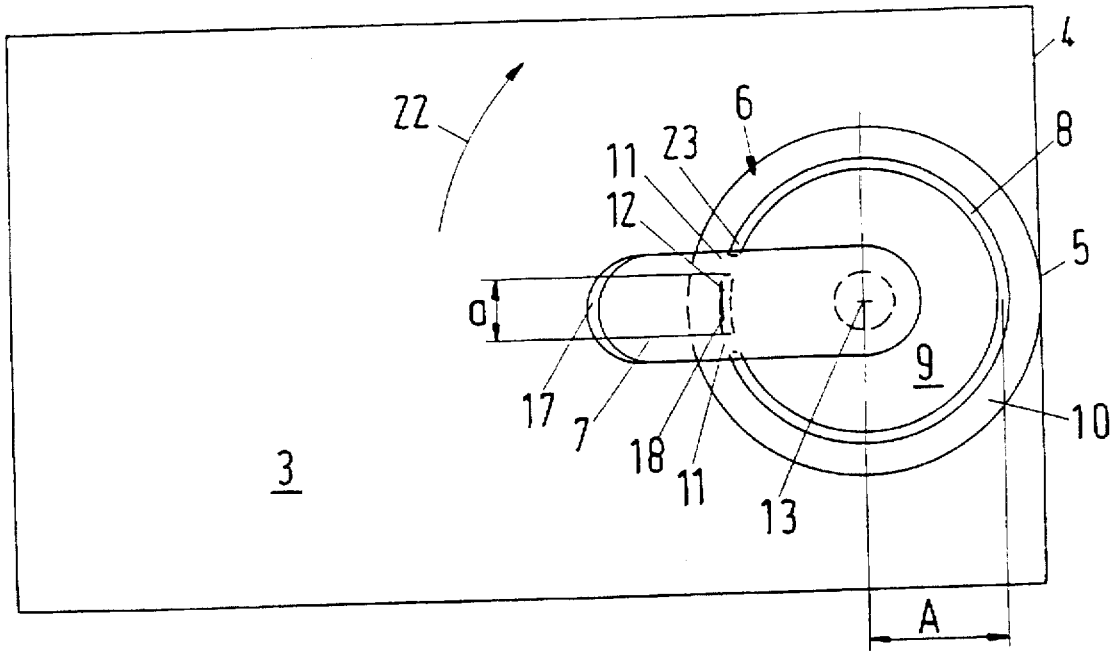
FIG. 1 is a plan view of a cuboidal pack produced by folding, or its flat rectangular top wall with, at the right-hand side thereof, near a pouring edge, the opening arrangement whose tongue is in the rest position.

The fluid pack which is not shown in greater detail is of a cuboidal form with a side wall 1, a front wall 2 and a top wall 3 which are connected together by way of a front fold edge 4. The term 'front' here means that side of the top wall 3 at which the pouring edge 5 of the opening arrangement is disposed.

The opening arrangement comprises a disk 6 and a tongue 7 which is arranged rotatably with respect to the disk and non-closably thereon.

The disk in turn comprises plastics material and is sealed in its entirety on the top wall 3 of the pack. The disk 6 is divided into an inner circular disk portion 9 and an outer annular portion 10 by a slot 8 which extends in a circular configuration over about 280°. The two portions 9 and 10 are separated from each other except for two web-like bridging portions 11 which are arranged at a spacing a frame each other. Disposed between them is a blind recess 12 in the disk, which is open upwardly away from the top wall 3, as can be particularly clearly seen from the cross-sectional view in FIG. 2. Both the inner circular disk portion 9 and also the outer annular portion 10 are sealed separately from each other in a flat configuration on the surface of the plastic material of the top wall 3. Before the pack is open for the first time therefore the inner circular disk portion 9 is fixed to the pack by way of the top wall 3 at the underneath and the web-like bridging portions 11 at the rear.

Figure 2:
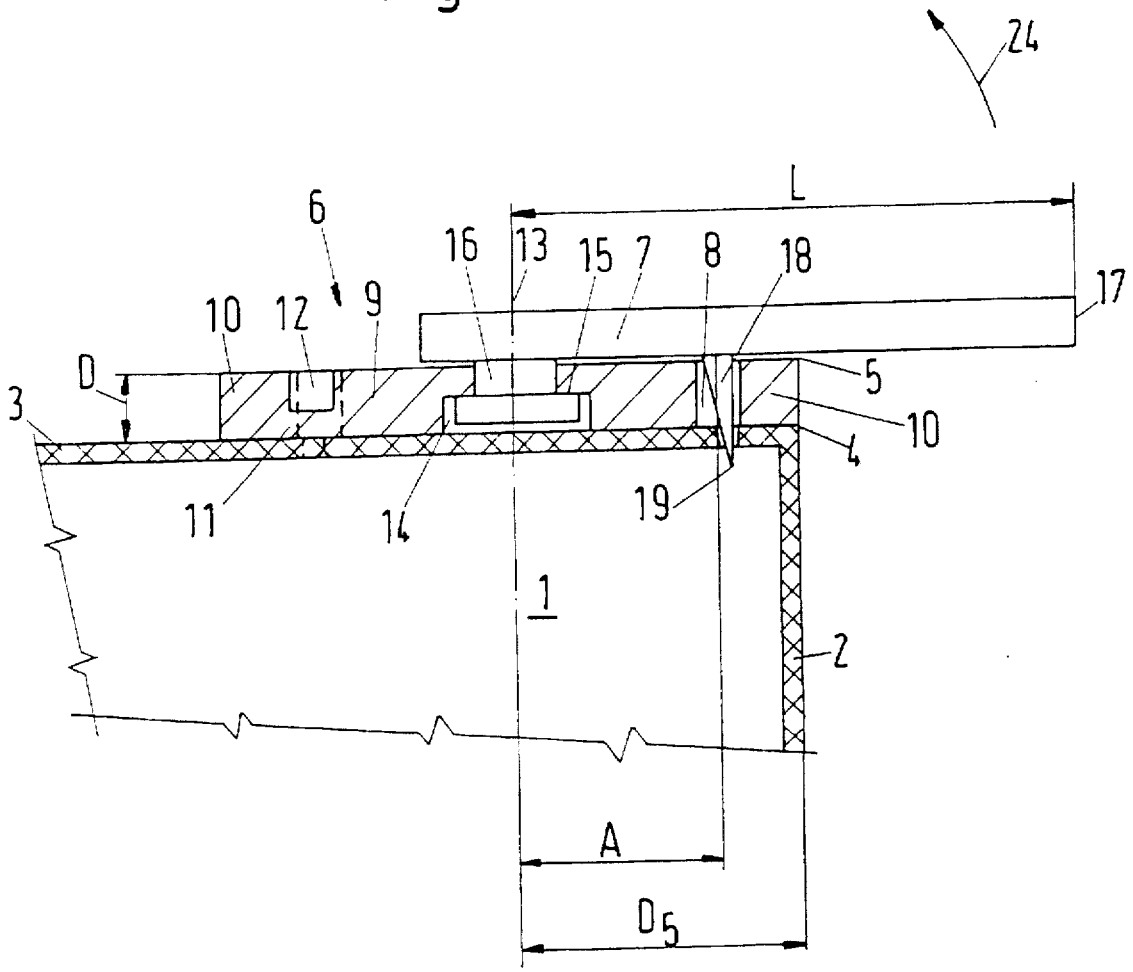
FIG. 2 is a view in cross-section through such a pack with the disk which is sealed in position on the top wall of the pack but in which the tongue has been rotated into the three o'clock position and the blade is shown as extending through the slot in the disk and the material of the top wall.
Figure 3:
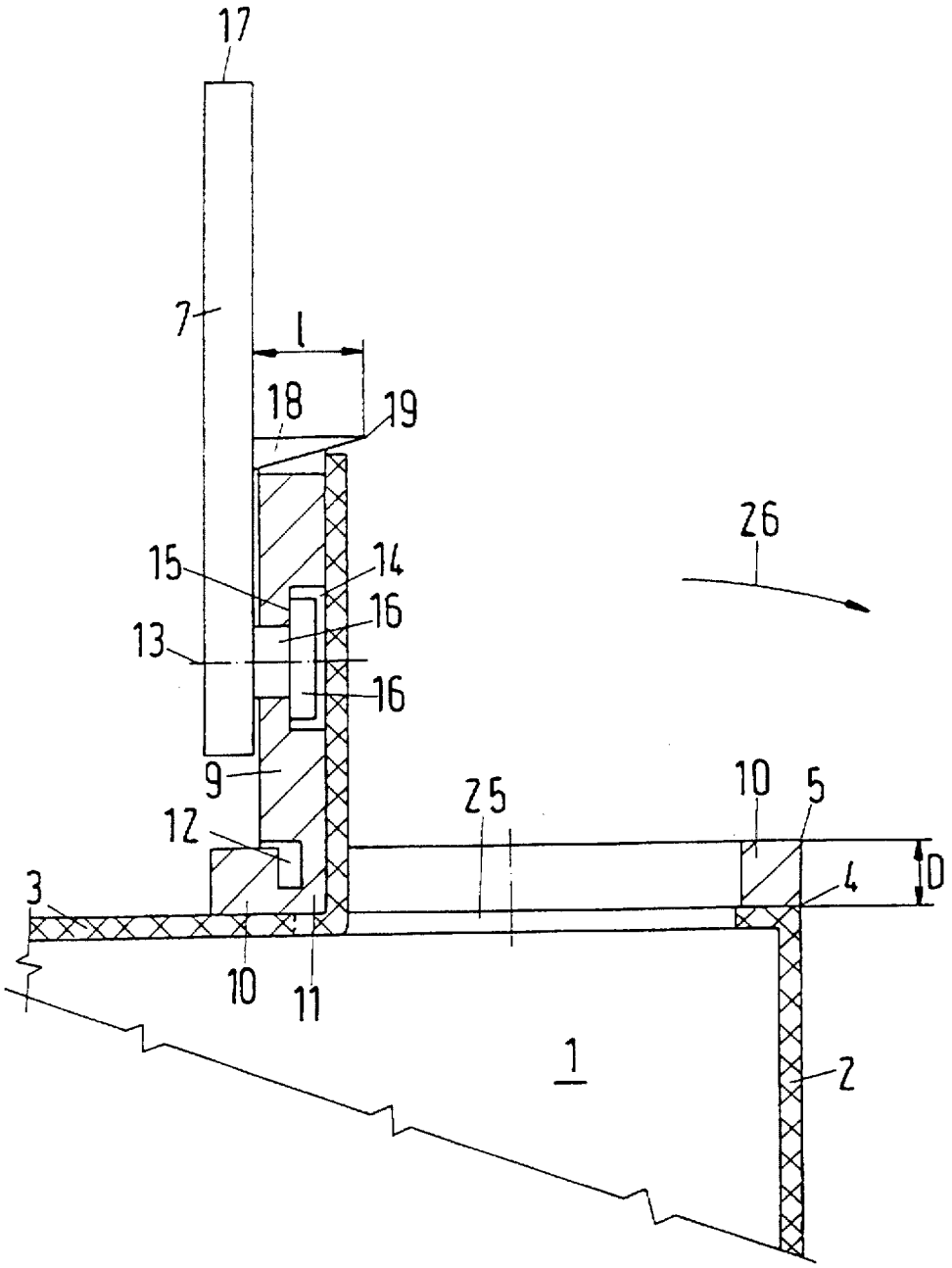
FIG. 3 is a similar view to FIG. 2 but in which the tongue with the disk and the portion of the top wall therebeneath has been pivoted out into the open position.

An opening 14 is formed in the disk 7 at the center (axis of rotation 13). As shown in FIGS. 2 and 3 (in cross-section) the opening 14 increases in size towards the top wall 3 in such a way as to provide a shoulder 15. The opening 14 extends entirely through the thickness D of the disk 6, 9, 10. In other words, when viewing the disk 6 from below, the viewer would view on to a cylindrical hole of larger diameter while when viewing from the opposite side from above on to the disk 6, the viewer would be looking on to a smaller cylindrical hole, which two holes go one into the other. The axis of rotation 13 is disposed in the center of the through hole, that is to say the central opening 14.

A rotary pin 16 with its axis of rotation 13 is molded on the tongue 7 in the rear region thereof and is of a configuration corresponding to the opening 14. It therefore has a cylinder which faces from the underside of the tongue 7 towards the top wall 3, of smaller diameter, and further downwardly, fitted thereto, a cylindrical portion of somewhat larger diameter which bears against the shoulder 15 of the opening 14 and which is thereby prevented from dropping out in an upward direction.

A blade 18 with a pointed bottom edge 19 is mounted to the underside of the tongue 7 at a spacing A from the axis of rotation 13 of the rotary pin 16, towards the front end 17 of the tongue 7. Except when the blade 18 is arranged in the blind recess 12 or is disposed above the web-like bridging portions 11, the blade 18 projects downwardly into the slot 8 in the disk 6 towards the top wall 3 or, after being pressed down, it projects through the top wall 3, as shown in the cross-sectional view in FIG. 2. The length 1 of the blade 18 is greater than the thickness D of the disk 6, as can be clearly seen from FIGS. 2 and 3. It will be appreciated that the spacing A of the blade 18 from the axis of rotation 13 on the tongue is accordingly equal to the radius of the part-circular slot 8 in the disk 6.

Figure 4:
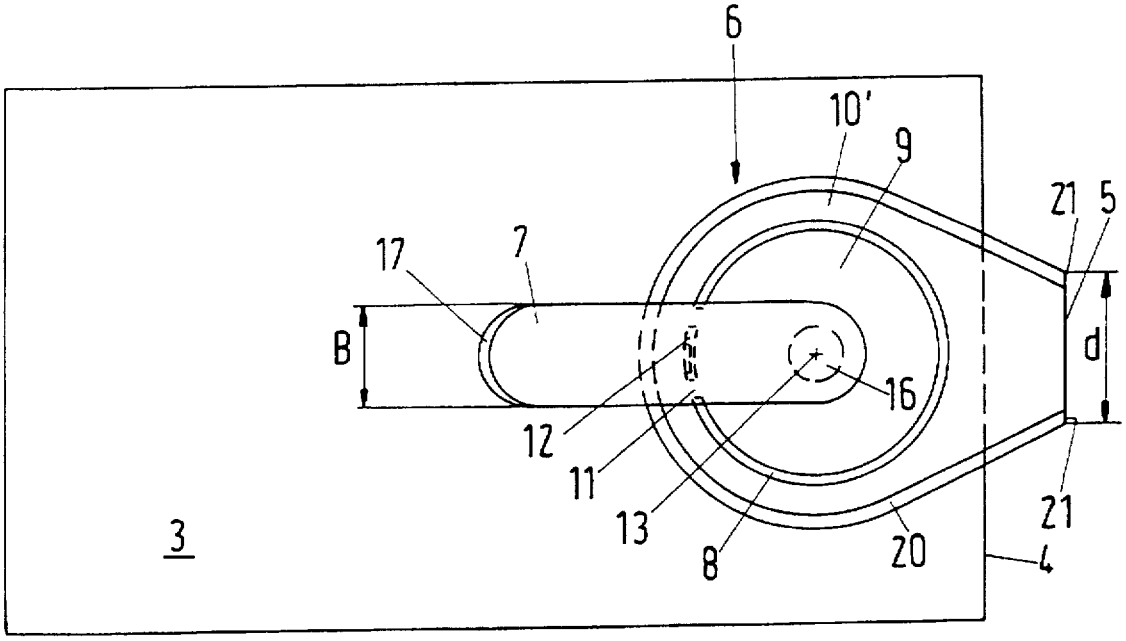
FIG. 4 is a plan view of a cuboidal pack with an opening arrangement, disposed at one side (at the right) in another embodiment with a pouring-assistance edge.

In the embodiment shown in FIG. 4, provided at the periphery of the disk 6, with the exception of the pouring edge 5, is a pouring-assistance edge 20 which is closed in a semi-circular configuration in a rearward direction (towards the center of the top wall 3) and which —in a plan view on to the disk 6—extends rectilinearly in a funnel-like shape forwardly to the ends 21. The spacing d of the two ends 21 of the pouring-assistance edge 20 from each other is a little larger than the width B of the tongue 7. In that way the tongue can be rotated out of the position shown in FIG. 4, through 180°, and fixed in the three o'clock position which is then reached (upon very close consideration, the spacing d in FIG. 4 is to be imagined as somewhat smaller and more closely approximated to the width B).

The length L of the tongue 7 from its front end 17 to the axis 13 of the rotary pin 16 can be particularly clearly seen from FIG. 2. That length L is 2 cm greater than the spacing D5 of the spacing of the pouring edge 5 from the same axis 13 of the rotary pin 16. As shown in FIG. 2, that ensures that the tongue 7 advantageously projects beyond the front wall 2 of the pack and guarantees good handling of the opening arrangement, as will now be described.

In operation the user grips the tongue 7 at the front end 17 in the position shown in FIG. 1. In that way the tongue 17 in its nine o'clock position is bent upwardly somewhat at the front, at the end 17, whereby the blade 18 is lifted out of the blind recess 12. Thereafter the user rotates the tongue 7 for example in the clockwise direction as indicated by the curved arrow 22, with the front end 17 of the tongue 7 still being held in the upwardly bent configuration in such a way that the lower cutting edge 19 of the blade 18 slides over the web-like bridging portion 11. It is therebehind that the circular slot 18 begins, at the location 23. Here, the user releases the front end 17 of the tongue 7 whereby the blade 18 with its front edge 19 passes downwardly through the slot 8 on to the top wall and cuts through it. The user can possibly enhance the piercing procedure by pressing on to the front end 17 of the tongue 7 downwardly towards the top wall. Now, from the location 23, the front edge 19 of the blade 18 begins engagement with the paper of the top wall 3 when the tongue 7 is further rotated through almost 360°, for example 280°, about the axis of rotation 13, in the direction of the curved arrow 22 (clockwise direction). In that movement the blade 18 follows the slot 8 and severs the top wall over precisely that part of a circle. The user now rotates the tongue 7 out of the eight o'clock position back into the three o'clock position again, as shown in the cross-sectional view in FIG. 2.

The user grips the tongue 7 at the front end 17 thereof from below and now pivots the inner portion of the top wall which approximately corresponds to the inner circular disk portion 9 of the disk 6 in the direction of the arrow 24 which is curved upwardly and towards the left in FIG. 2, until the opening position of the tongue 7, the disk 6 and the top wall 3 as shown in FIG. 3 is reached. It is possible to see the pouring opening 25 through which the filling material which is capable of flow can be poured out towards the right in the direction of the arrow 26 in FIG. 3, over the pouring edge 5.

For re-closure purposes the tongue 7 with the inner circular disk portion 9 only needs to be pivoted downwardly again in the clockwise direction so as to reach the position shown in FIG. 2 (reclosed).

The handling procedure for opening of and re-closing of the opening arrangement shown in the alternative embodiment of FIG. 4 takes place in the same manner.

List of references

| | |
|---|---|
| 1 | side wall |
| 2 | front wall |
| 3 | top wall |
| 4 | fold edge |
| 5 | pouring edge |
| 6 | disk |
| 7 | tongue |
| 8 | slot |
| 9 | circular disk portion |
| 10 | annular portion |
| 11 | bridging portions |
| 12 | recess |
| 13 | axis of rotation |
| 14 | opening |
| 15 | shoulder |
| 16 | rotary pin |
| 17 | front end of the tongue 7 |
| 18 | blade |
| 19 | lower edge |
| 20 | pouring-assistance edge |
| 21 | ends |
| 22 | arrow |
| 23 | location |
| 24 | arrow |
| 25 | pouring opening |
| 26 | arrow |
| 40 | opening |
| A | spacing |
| B | width |
| d | spacing |
| D | thickness of the disk 6, 9, 10 |
| D5 | spacing |
| 1 | length of theblade 18 |
| L | length |

What is claimed is:

1. An arrangement for opening and re-closing a fluid pack comprising:

a disk of plastic material sealed on a top wall of said fluid pack, said disk having an opening in the center thereof and spaced from said opening and extending in a circular configuration over almost 360°, said slot being interrupted by at least one bridging portion;

a tongue having a rotary pin coupled to said opening in said disk for rotation around said opening; and a blade fixed to said tongue on an underside thereof and spaced from said rotary pin to project into said slot, said blade being longer than a thickness of said disk.

2. An arrangement for opening and re-closing a fluid pack according to claim 1 wherein said at least one bridging portion comprises two web-like bridging portions which are spaced from each other and between which an upwardly open blind recess is provided in said disk.

3. An arrangement for opening and re-closing a fluid pack according to claim 2 wherein said opening is enlarged towards said top wall of said fluid pack.

4. An arrangement for opening and re-closing a fluid pack according to claim 3 further comprising a pouring-assistance edge at a periphery of said disk except for a pouring edge defined by said disk.

5. An arrangement for opening and re-closing a fluid pack according to claim 4 wherein said poring-assistance edge terminates at two ends adjacent said pouring edge and said two ends of said pouring-assistance edge are spaced from each other by a distance which is larger than a width of said tongue.

6. An arrangement for opening and re-closing a fluid pack according to claim 5 wherein said tongue is of a flat and elongate configuration so that a length of said tongue from said rotary pin to a distal end of said tongue is 1 to 3 cm and preferably 2 cm greater than a spacing of said opening from said pouring edge.

7. An arrangement for opening and re-closing a fluid pack according to claim 3 wherein said opening extends entirely through said disk.

8. Apparatus for forming an opening in a fluid pack comprising:

an opening member secured to said fluid pack and comprising an inner disk portion and an outer portion surrounding said inner disk portion, said inner disk portion being partially separated from said outer portion by a circular slot extending over a substantial portion of said opening member, being generally centered upon said inner disk portion and being interrupted by a bridging portion;

a tongue having a first end mounted to said inner disk portion of said opening member for rotation around said inner disk portion; and a blade fixed to said tongue and spaced from said first end of said tongue to be received within said circular slot when said tongue is rotated, said blade being longer than said opening member is thick.

9. Apparatus for forming an opening in a fluid pack according to claim 8 wherein said opening member defines a pouring edge for said fluid pack and said bridging portion being generally opposite said pouring edge.

10. Apparatus for forming an opening in a fluid pack according to claim 9 wherein said bridging portion defines a blind recess for receiving said blade.

11. Apparatus for forming an opening in a fluid pack according to claim 8 wherein a second end of said tongue extends beyond said opening member.

* * * * *

UNITED STATES PATENT AND TRADEMARK OFFICE

CERTIFICATE OF CORRECTION

PATENT NO : 5,755,359

DATED : May 26, 1998

INVENTOR(S) : Leif T. Jöensson

It is certified that error appears in the above-identified patent and that said Letters Patent is hereby corrected as shown below:

Col. 7, line 54, "and spaced from" should read --and a slot spaced from--.

Signed and Sealed this

Sixteenth Day of February, 1999

*Attest:*

*Attesting Officer*

*Acting Commissioner of Patents and Trademarks*